US008186972B1

(12) United States Patent
Glauber

(10) Patent No.: US 8,186,972 B1
(45) Date of Patent: May 29, 2012

(54) MULTI-STAGE EXPANSIBLE CHAMBER PNEUMATIC SYSTEM

(75) Inventor: Carl J. Glauber, Jamesville, NY (US)

(73) Assignee: Wilden Pump and Engineering LLC, Grand Terrace, CA (US)

( * ) Notice: Subject to any disclaimer, the term of this patent is extended or adjusted under 35 U.S.C. 154(b) by 1087 days.

(21) Appl. No.: 12/008,948

(22) Filed: Jan. 15, 2008

Related U.S. Application Data

(60) Provisional application No. 60/880,519, filed on Jan. 16, 2007.

(51) Int. Cl.
*F04B 35/00* (2006.01)

(52) U.S. Cl. ..... 417/399; 417/254

(58) Field of Classification Search ..... 417/245, 417/246, 255, 258, 267, 384, 391, 392, 393, 417/394, 395, 396, 397, 399, 254; 91/307, 91/310, 311, 313, 314, 420, 520
See application file for complete search history.

(56) References Cited

U.S. PATENT DOCUMENTS

| | | | | | |
|---|---|---|---|---|---|
| 236,992 | A | * | 1/1881 | Cushier | 417/262 |
| 1,820,236 | A | * | 8/1931 | Loud | 261/34.1 |
| 3,540,349 | A | * | 11/1970 | Pennther | 91/306 |
| 3,630,642 | A | | 12/1971 | Osterman | 417/65 |
| 3,890,064 | A | * | 6/1975 | Boehringer et al. | 417/237 |
| 4,247,264 | A | | 1/1981 | Wilden | 417/393 |
| 4,494,912 | A | | 1/1985 | Pauliukonis | 417/347 |
| 4,496,294 | A | | 1/1985 | Frikker | 417/393 |
| 4,502,848 | A | | 3/1985 | Robertson et al. | 417/380 |
| 4,653,986 | A | * | 3/1987 | Ashton | 417/243 |
| 4,818,191 | A | * | 4/1989 | Schlake | 417/390 |
| 4,830,586 | A | * | 5/1989 | Herter et al. | 417/395 |
| 5,007,812 | A | | 4/1991 | Hartt | 417/534 |
| 5,273,405 | A | * | 12/1993 | Chalmers et al. | 417/397 |
| 5,324,175 | A | | 6/1994 | Sorensen et al. | 417/254 |
| 5,616,005 | A | * | 4/1997 | Whitehead | 417/46 |
| 5,927,954 | A | | 7/1999 | Kennedy et al. | 417/397 |
| 6,036,445 | A | | 3/2000 | Reynolds | 417/53 |
| 6,158,982 | A | | 12/2000 | Kennedy et al. | 417/397 |
| 6,210,131 | B1 | * | 4/2001 | Whitehead | 417/397 |
| 7,517,199 | B2 | | 4/2009 | Reed et al. | 417/46 |
| 7,527,483 | B1 | | 5/2009 | Glauber | 417/395 |
| 2011/0236224 | A1 | | 9/2011 | Glauber | 417/46 |

* cited by examiner

*Primary Examiner* — Devon C Kramer
*Assistant Examiner* — Dnyanesh Kasture
(74) *Attorney, Agent, or Firm* — Connolly Bove Lodge & Hutz LLP

(57) ABSTRACT

A multi-stage expansible chamber pump system includes a HP pump unit, and first and second LP pump units. The LP units each include a LP air chamber and a pumped fluid chamber, separated by a piston. The HP unit includes left and right HP air chambers separated by a piston. Pistons are coaxial on a common piston rod for reciprocating movement in unison. A direction control DC valve includes a valve spool movable between first and second positions. The DC valve receives high pressure shop air as Control air and Process air. Control air moves the DC valve spool alternately to first and second positions. The DC valve, as determined by the position of the spool, directs Process air alternately to one side, then the other, of the HP unit, whereby the pistons reciprocate in unison to pump fluid through the fluid chambers.

11 Claims, 3 Drawing Sheets

Spool 21, First Position
(shown above)

Spool 21, Second Position

MULTI-STAGE EXPANSIBLE CHAMBER PNEUMATIC SYSTEM

CROSS-REFERENCE TO RELATED APPLICATION

This application relates to my copending Provisional Patent Application No. 60/880,519 which was filed on Jan. 16, 2007. That filing date is claimed for this application.

BACKGROUND OF THE INVENTION

High pressure shop air, or "HP air" is typically pressurized in a compressor to about 125 psig for storage in a tank for various shop uses. Storage tank pressure typically ranges from a high of 125 psig to a low of 115 psig, at which point the compressor comes on again to raise the pressure back to 125 psig. HP air from the tank is piped throughout the plant as Motive air for pneumatic equipment, or as pressurized air for purposes such as spraying or cleaning. While "high pressure" has to be high enough to meet all of these various requirements, some equipment operates at pressures lower than the "high pressure" level. For such lower pressure applications, a pressure reducing valve is required upstream of the equipment to reduce the pressure input to such equipment. A pressure reducing valve is a modulating orifice which allows high pressure air to expand to a lower pressure.

The problem with prior art systems as just described is that HP air is wasted by putting it through a reducing valve, wasting also the energy used to compress the HP air in the first place.

Factories often use many and various types of air driven equipment with varying requirements of air pressure and flow rate. The compressor and associated air tank are sized to meet the total pressure and volume requirements of all the pneumatic equipment in the factory. Typical pneumatic equipment takes in "Motive" air, and divides it into "Control" and "Process" air. Control air controls equipment operation. Process air does the work. In an air-operated diaphragm pump, Control air operates air direction control (DC) valves which direct Process air against the pump diaphragm, thereby to pump fluid (liquid or gas). Control air and Process air combined are then both exhausted from the pump to atmosphere.

It is an industry rule of thumb that a 2 psi change of output pressure corresponds with a 1% change of horsepower required to generate it. Thus, a pressure reduction as described above, from 125 psig to, say, 75 psig (a 50 psi reduction) represents a waste of 25% of the energy required to generate it. In other words, 25% less horsepower is required to compress air to 75 psig than is required to compress air to 125 psig. Another industry standard, relevant here, is that one horsepower is required to compress 4 cfm to 100 psig (i.e. 4 cfm/hp).

In addition to the term "high pressure" (HP), the term "low pressure" (LP) is used herein, abbreviated as indicated.

Pumps of the type described here are disclosed in U.S. Pat. No. 4,247,264 to Wilden.

SUMMARY OF THE INVENTION

In summary, this invention is a multi-stage expansible chamber pneumatic system, for example a fluid pump system, including two or more stages of Process air expansion. The stages are in series so that HP air expands from one stage to the next. Each stage of expansion reduces Process air pressure, releasing energy to perform work. Multiple expansions allow Process air to be used more than once before it is expelled to atmosphere. Multi stage expansion from HP shop air downward approaching atmosphere, uses all or most of the available energy stored in the Process air. The pump has symmetrical left and right pump units, including air and fluid chambers separated by a movable piston for reciprocating movement in unison to pump fluid through their respective fluid chambers. Each pump includes an air direction control (DC) valve actuated by Control air to direct Process air alternately to left and right multi stage pump units, expanding the air in each stage, simultaneously releasing used Process air from an opposite air chamber to thereby move piston and diaphragms to pump fluid. An air relief valve is responsive to the air chamber piston reaching its travel limits to release Control air from the DC valve, alternating and directing Process air flow through the DC valve to reverse movement of diaphragms and piston. The relief valve exhausts Control air to atmosphere. The DC valve directs Process air through the pump, finally exhausting it to atmosphere.

More broadly, this invention is a multi-stage expansible chamber pneumatic system, including separate left and right pump units each including a chamber with a reciprocally movable piston. The pistons are connected to a common rod for movement in unison. An air direction control (DC) valve directs Process air to left unit HP air chamber and exhausts twice used Process air from left unit LP air chamber, simultaneously directing once used Process air from right unit HP air chamber to right unit LP air chamber, thereby moving pistons in a first direction. A relief valve is responsive to pistons reaching their travel limits to release Control air from the DC valve, alternating and directing Process air flow through the DC valve to reverse movement of the pistons. The pressure relief valve exhausts Control air to atmosphere. The DC valve directs Process air through the pump and exhausts it to atmosphere.

DRAWINGS

DETAILED DESCRIPTION

Figure 1:
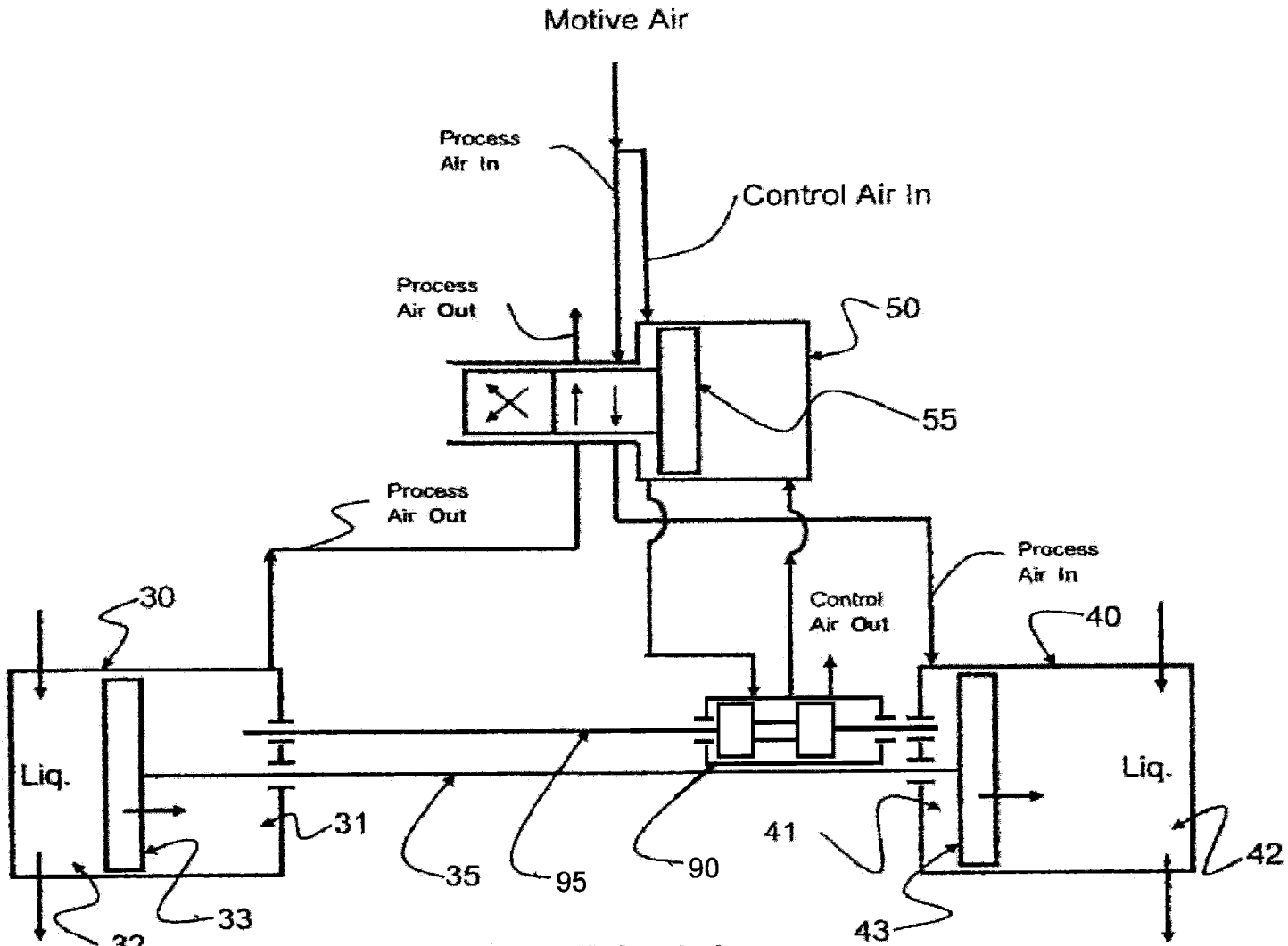
Fig. 1 (Prior Art)
FIG. 1 is a schematic view of a prior art expansible chamber pump system.

FIG. 1 is a schematic diagram of a current (prior art) air-operated double diaphragm pump. It is illustrated to simplify an understanding of this invention. The pump includes symmetrical left and right pump units 30, 40. The left unit 30 includes an air chamber 31 on its inner end, a liquid chamber 32 on its outer end, and a movable pump piston 33 separating the two chambers. The right unit 40 similarly includes an air chamber 41 on its inner end, a liquid chamber 42 on its outer end, and a movable pump piston 43 separating the two chambers. The pistons 33, 43, which reciprocate in their respective units, are connected by a connecting rod 35 for reciprocating movement in unison.

Motive air enters the pump via a Direction Control (DC) valve 50. A small amount (<1%) of the Motive air is diverted as Control air to operate the DC valve 50. The rest (>99%) is Process air to perform work. Control air acts against a piston 55 in the DC valve 50 to direct Process air alternately to the right air chamber 41, then to left air chamber 31, then to right air chamber 41, and so on, continuously.

In FIG. 1, Control air has moved the DC valve piston 55 to the left. In this condition, the DC valve 50 (i) directs Process air to the right air chamber 41, moving the piston 43 to the right to pump fluid from liquid chamber 42, and (ii) directs Process air exhausted from the left air chamber 31 to atmosphere.

The DC valve 50 directs Process air alternately to right and left air chambers 41, 31, as determined by, respectively, left and right positions of the piston 55 in the DC valve 50. Alternating left/right positions of the piston 55 are, in turn, controlled by Control air directed from a pilot valve 90 which includes a pilot actuator rod 95. The actuator rod 95 is mounted between the pistons 33, 43 for abutment with one, then the other, of the pistons in sequence as they move back and forth. Thus do the pistons 33, 43 move the pilot valve 90 into its alternate positions to direct Control air movement to one side, then the other, of the DC valve piston 55.

From their position shown in FIG. 1, as the pistons 33, 43 move to the right, piston 33 abuts the pilot actuator rod 95 to move the pilot valve 90 to the right, to the position shown to one in which the pilot valve 90 exhausts Control air to atmosphere (FIG. 1, Control Air Out). Piston 55 then moves to the right, in which position the DC valve 50 (i) directs Process Air to the left air chamber 31, moving the piston 33 to the left to pump fluid from liquid chamber 32, and (ii) directs Process air exhausted from the right air chamber 41 to atmosphere.

Figure 2:
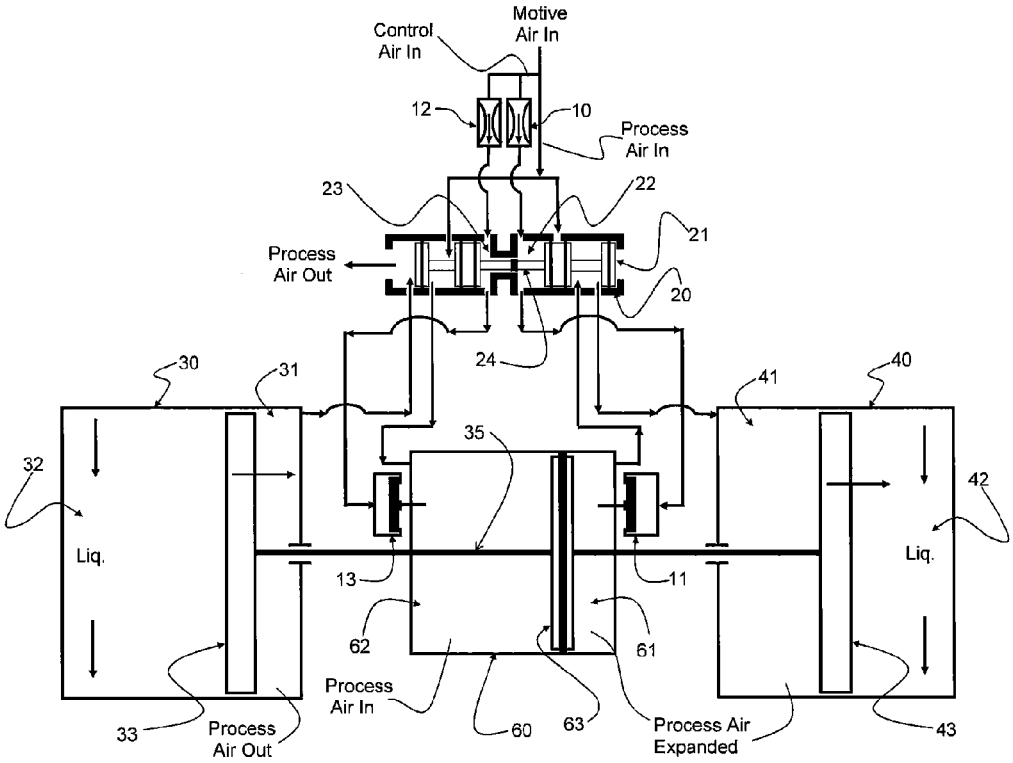
FIG. 2 is a schematic view of an expansible chamber pump system with high and low pressure chambers.

FIG. 2 is a schematic diagram of a pump according to this invention. The pump includes symmetrical left and right pump units 30, 40. The left unit 30 includes a second stage (or LP) air chamber 31 on its inner end, a liquid chamber 32 on its outer end, and a movable pump piston 33 separating the two chambers. The right unit 40 similarly includes a second stage LP air chamber 41 on its inner end, a liquid chamber 42 on its outer end, and a movable pump piston 43 separating the two chambers. A center pump unit 60 includes a first stage (HP) right side air chamber 61 and first stage HP left side air chamber 62, and a movable pump piston 63 separating the two chambers. The pistons 33, 63, 43 reciprocate in their respective units, and are connected by a connecting rod 35 for movement in unison.

Figure 2A:
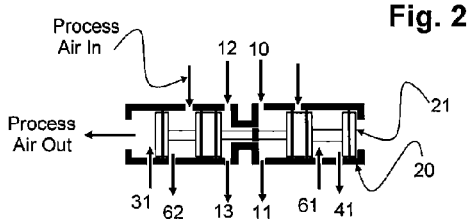
FIG. 2A is a spool valve employed in the system of FIG. 2 as a directional control valve in a first shift position.
Figure 2B:
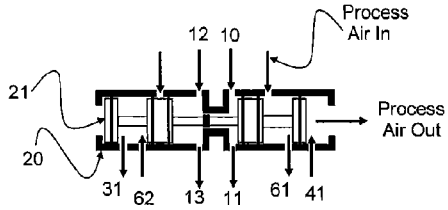
FIG. 2B is a functional representation of a spool valve employed in the system of FIG. 2 as a directional control valve in a second shift position.

Motive air enters the pump via a Direction Control (DC) valve 20. The DC valve 20 is shown in alternate shift positions in FIGS. 2A and 2B. A small amount (<1%) of the Motive air is diverted as Control air through parallel flow orifices 10, 12 to DC valve 20 and to respective pressure relief valves 11, 13. The rest (>99%) is Process air to perform work. Control air acts against a spool 21 in the DC valve 20 to direct Process air, alternately (i) to left side HP air chamber 62, and from right side HP air chamber 61 to right LP air chamber 41, (ii) to right side HP air chamber 61, and from left side HP air chamber 62 to left LP air chamber 31, and so on, continuously. The DC valve includes chambers 22, 23, each with a piston or spool 21, the spools connected to each other by a spool rod 24.

In FIG. 2, Control air flows at a given rate into DC valve 20, pressurizing its chambers 22, 23, holding the spool 21 to the right and holding pressure relief valves 11, 13 closed. In this condition, the DC valve spool 21 (i) directs Process air into left HP air chamber 62; (ii) exhausts twice-used Process air to atmosphere from left LP air chamber 31; and (iii) expands once-used Process air from right side HP air chamber 61 to right side LP air chamber 41, moving pistons 33, 63, 43 to the right to thereby pump fluid from liquid chamber 42.

The DC valve 20 directs Process air alternately to the left side HP air chamber 62; then to the right side HP air chamber 61, then back to the left side, and so on. The DC valve 20 also directs once-used (LP) Process air alternately from the HP chambers 61, 62 to corresponding LP chambers 41 or 31 according to the respective right or left position of the spool 21 in the DC valve 20. Alternating right/left positions of the spool 21 are, in turn, controlled by releasing Control air from air chambers 22, 23 through their respective relief valves 11, 13 at a rate greater than the input rates from their respective flow orifices 10, 12. Control air is released through relief valves 11, 13 as they are opened alternately by contact with the HP piston 63 at each end of its stroke.

From their positions shown in FIG. 2, as the pistons 33, 63, 43 move to the right, piston 63 abuts the relief valve 11 which releases Control air from air chamber 22 of DC valve 20 at a rate greater than is being supplied from flow orifice 10. Control air supplied to air chamber 23 of DC valve 20 moves the spool 21 left from the position shown. In this new condition, the DC valve spool 21 directs Process air (i) into right side HP air chamber 61, (ii) exhausts twice-used Process air to atmosphere from right side LP air chamber 41, (iii) expands once-used Process air from left side HP air chamber 62 to the left side LP air chamber 31, moving pistons 33, 63, 43 to the left to pump fluid from liquid chamber 32. As pistons 33, 63, 43 move to the left pumping fluid from liquid chamber 32, the piston 63 abuts the relief valve 13 to release Control air from air chamber 23 at a rate greater than it is being supplied from flow orifice 12. Control air supplied to air chamber 22 of DC valve 20, moves spool 21 to the right and the sequence begins again.

Figure 3:
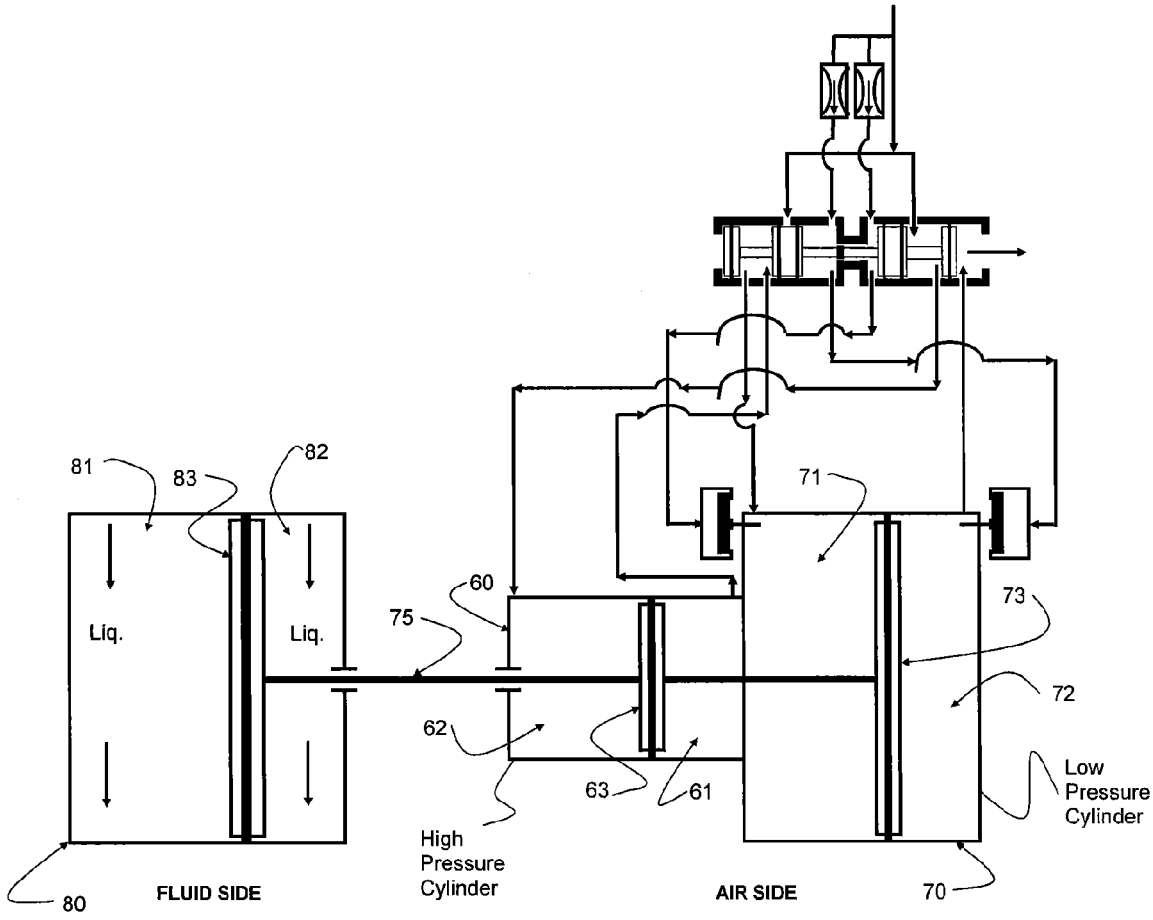
FIG. 3 is a schematic view of a second embodiment of an expansible chamber pump system with high and low pressure chambers.

FIG. 3 shows a system similar to that of FIG. 2, but with its low pressure air stages and fluid pumps rearranged. At the right end of FIG. 3, an "air side" pump unit 70 includes a left side LP air chamber 71 and a right side LP air chamber 72, separated by a piston 73. At the left end of FIG. 3, a "fluid pump" unit 80 includes a left side pump chamber 81 and a right side pump chamber 82, separated by a piston 83. Pistons 73 and 83 are connected by a connecting rod 75 for reciprocal movement in unison. Between the air side unit 70 and fluid pump unit 80 is a center air side HP pump unit 60 which is the same as that described above in connection with FIG. 2. The piston 63 of the center HP pump 60 is also connected to the piston rod 75 for reciprocation with pistons 73 and 83. Pneumatic operation of the air side HP and LP cylinders, and fluid pumping in the left and right pump chambers 81, 82, are as described with FIG. 2.

As an example for comparison of this system with the prior art: consider a system that requires output fluid flow of 104 gpm at a pressure of 20 psig. To meet that requirement, a prior art single-pump system (FIG. 1), requires compressed air at 60 psig and 60 scfm.

In a multi-stage expansible chamber pump system of this invention, compressed air enters the small volume HP air chamber at a high pressure of 120 psig, simultaneously once-used Process air expands into a larger volume LP air chamber at 12 psig. This combination of HP and LP stages produces an output fluid flow of 104 gpm at a pressure of 20 psig. Air is exhausted at 12 psig and a rate of 36 scfm. The prior art system requires 60 scfm to perform the work. The multi-stage pump system of this invention requires 36 scfm to perform the same work, saving 24 scfm or 40% energy savings.

Benefits of this invention, vis a vis a prior art pump system, are as follows: It produces increased output fluid flow per unit of input air. It reduces air volume requirement and energy consumption significantly. It reduces the possibility of freeze-up from compressed air expansion because air flow is reduced and its expansion is in stages rather than all at once. Reduced supply air flow reduces friction loss in supply piping to the pump. Exhaust porting from the LP stage to atmosphere is oversized to eliminate pressure drop and loss of efficiency from exhausting twice used Process air. Control air components are not affected if a pump diaphragm should break or fail and pump fluid should enter the Process air flow path. Components in the Control air flow path are external, serviceable without pump disassembly.

In this invention, unlike the prior art, Motive air is not pressure-reduced, then used once, then wasted to atmosphere. Instead, Motive air is taken in directly as HP shop air, so the pump can extract as much of its potential energy as possible by expanding the Process air in stages.

Some pneumatic pumps to which this invention relates have diaphragms instead of pistons. However, for the sake of illustration the prime movers of this system are shown and described as pistons. Pistons and diaphragms are, for present purposes, hydraulically and pneumatically equivalent. Thus, "piston" in this description and in the following claims includes "diaphragm".

Dimensions of HP elements of this multi-stage system are different from those of corresponding LP elements. The concept of this invention is not limited by dimensions, ratios, and the like. These parameters are matters of design to fit specific system requirements.

In the following claims: "HP" and "high pressure" mean shop air pressure as discussed in the foregoing background and description. "Air" is the operating medium of this system. "Fluid" is liquid or gas being pumped by the system.

Claims 1-5 below relate to the embodiment of FIG. 2. Claims 6-8 relate to that of FIG. 3.

Terms indicative of orientation are intended as description with reference to the drawings. Described structure retains its character whether oriented as shown or otherwise.

The foregoing description of a preferred embodiment is illustrative of the invention. The concept and scope of the invention are, however, limited not by the details of that description but only by the following claims and equivalents thereof.

What is claimed is:

1. A multi-stage expansible chamber pump system, comprising:

first and second pump units (30, 40) each including a low pressure air chamber (31, 41), a fluid chamber, and a pump piston separating said low pressure air and fluid chambers;

a high pressure pump unit (60) including left and right side high pressure air chambers (62, 61) and a high pressure pump piston separating said left and right side high pressure air chambers;

said pump piston (33) of the first pump unit, said pump piston (43) of the second pump unit and said high pressure pump piston (63) disposed on a common piston rod (35) for reciprocating movement in unison with said common piston rod;

a direction control valve disposed to receive high pressure air divided into a Control air component and a Process air component;

said Control air component effective to dispose said direction control valve alternately in a first valve condition and a second valve condition to direct said Process air component alternately in a sequence wherein the Process air component is directed:

a. to said left side high pressure air chamber (62), and from said right side high pressure air chamber (61) to said low pressure air chamber (41) of the second pump unit, and from said low pressure air chamber (31) of the first pump unit to atmosphere; and b. to said right side high pressure air chamber (61), and from said left side high pressure air chamber (62) to said low pressure air chamber (31) of the first pump unit, and from said low pressure air chamber (41) of second pump unit to atmosphere, and c. again to said left side high pressure air chamber, to continue the sequence;

whereby said pump piston (33) of the first pump unit, said pump piston (43) of the second pump unit, and said high pressure pump piston (63) reciprocate in unison to pump fluid through said fluid chamber (32) of the first pump unit and said fluid chamber (42) of the second pump unit.

2. A multi-stage expansible chamber pump system as defined in claim 1, said direction control valve responsive to each end of a reciprocating movement of said pump piston (33) of the first pump unit, said pump piston (43) of the second pump unit, and said high pressure pump piston (63) reciprocating in unison, to move either from the first valve condition to the second valve condition or from the second valve condition to the first valve condition.

3. A multi-stage expansible chamber pump system, comprising;

a first pump unit (30) including a first low pressure air chamber (31), a first fluid chamber (32), and a first pump piston separating said first low pressure air chamber and said first fluid chamber;

a second pump unit (40) including a second low pressure air chamber (41), a second fluid chamber (42), and a second pump piston separating said second low pressure air chamber and said second fluid chamber;

a high pressure pump unit (60) disposed between said first (30) and second (40) pump units, said high pressure pump unit (60) including left and right side high pressure air chambers (62, 61), and a high pressure pump piston separating said left side high pressure air chamber and said right side high pressure air chamber;

said first pump piston, said second pump piston, and said high pressure pump piston disposed coaxially on a common piston rod (35) for reciprocating movement in unison with said common piston rod;

a direction control valve including a direction control valve spool movable therein between a first position and a second position, said direction control valve disposed to receive high pressure air divided into a Control air component and a Process air component;

said Control air component directed to said direction control valve to move said direction control valve spool alternately to said first and second positions;

said direction control valve responsive to an alternation between first and second positions of said direction control valve spool to direct said Process air component alternately in a sequence wherein said Process air component is directed:

a. to said left side high pressure air chamber (62), and from said right side high pressure air chamber (61) to said second low pressure air chamber (41), and from said first low pressure air chamber (31) to atmosphere; and b. to said right side high pressure air chamber (61), and from said left side high pressure air chamber (62) to said first low pressure air chamber (31), and from said second low pressure air chamber (41) to atmosphere; and c. again to said left side high pressure air chamber, to continue the sequence;

whereby said first pump piston (33), said second pump piston (43), and said high pressure pump piston (63) reciprocate in unison to pump fluid through said first and second fluid chambers (32, 42).

4. A multi-stage expansible chamber pump system as defined in claim 3, said direction control valve spool responsive to each end of a reciprocating movement of said first pump piston (33), said second pump piston (43), and said high pressure pump piston (63) reciprocating in unison, to move either from the first position to the second position or from the second position to the first position of said direction control valve spool.

5. A multi-stage expansible chamber pump system as defined in claim 3, further comprising:

a first relief valve (13) communicating with said left side high pressure air chamber (62) and with said direction control valve, and responsive to said high pressure pump piston reaching a leftward end of a stroke of the high pressure pump piston to relieve a left side air pressure between said left side high pressure air chamber (62) and said direction control valve; and a second relief valve (11) communicating with said right side high pressure air chamber (61) and with said direction control valve, and responsive to said high pressure pump piston reaching a rightward end of the stroke of the high pressure pump piston to relieve a right side air pressure between said right side high pressure air chamber (61) and said direction control valve;

said direction control valve spool responsive to an alternating relief of the left and right side air pressure in said left and right side high pressure air chambers to move alternately to said first and second positions of said direction control valve spool.

6. A multi-stage expansible chamber pump system, comprising;

a pump unit (80) including first and second fluid chambers (81,82) on opposite sides of a pump piston (83);

a low pressure drive unit (70) including a first and second low pressure air chambers (71, 72) on opposite sides of a low pressure drive piston (73);

a high pressure drive unit (60) including left and right side high pressure air chambers (62, 61) on opposite sides of a high pressure drive piston (63);

said pump piston (83), low pressure drive piston (73), and high pressure drive piston (63) disposed coaxially on a common piston rod (75) for reciprocating movement in unison with said common piston rod;

a direction control valve including a direction control valve spool movable therein between first and second positions, said direction control valve disposed to receive high pressure air divided into a Control air component and a Process air component;

said Control air component directed to said direction control valve to move said direction control valve spool alternately to said first and second positions;

said direction control valve responsive to an alternation between first and second positions of said direction control valve spool to direct said Process air alternately in a sequence wherein said process air component is directed:

a. to said left side high pressure air chamber (62), and from said right side high pressure air chamber (61) to said first low pressure air chamber (71), and from said second low pressure air chamber (72) to atmosphere; and b. to said right side high pressure air chamber (61), and from said left side high pressure air chamber (62) to said second low pressure air chamber (72), and from said first low pressure air chamber (71) to atmosphere; and c. again to said left side high pressure air chamber (62), to continue the sequence;

whereby said pump piston (83), said low pressure drive piston (73), and said high pressure drive piston (63) reciprocate in unison to pump fluid through said first and second fluid chambers (81, 82).

7. A multi-stage expansible chamber pump system as defined in claim 6, said direction control valve spool responsive to each end of a reciprocating movement of said pump piston (83), said low pressure drive piston (73), and said high pressure drive piston (63) reciprocating in unison to move either from the first position to the second position or from the second position to the first position of said direction control valve spool.

8. A multi-stage expansible chamber pump system as defined in claim 6, further comprising:

a first relief valve communicating with said first low pressure air chamber (71) and with said direction control valve, and responsive to said low pressure drive piston reaching a leftward end of a stroke of the low pressure drive piston to relieve a first air pressure between said first low pressure air chamber (71) and said direction control valve; and a second relief valve communicating with said second low pressure air chamber (72) and with said direction control valve, and responsive to said low pressure drive piston reaching a rightward end of the stroke of the low pressure drive piston to relieve a second air pressure between said second low pressure air chamber (72) and said direction control valve;

said direction control valve spool responsive to an alternating relief of the first and second air pressures in said first and second low pressure air chambers to move alternately to said first and second positions of said direction control valve spool.

9. A multi-stage expansible chamber pump, comprising:

a. a high pressure housing of a first predetermined volume separated into first and second chambers by a first piston;

b. first and second low pressure housings of second and third predetermined volumes, respectively, each of the second and third predetermined volumes being greater than said first predetermined volume, wherein said first low pressure housing is separated into third and fourth chambers by a second piston and said second low pressure housing is separated into fifth and sixth chambers by a third piston;

c. a control air source having a directional control valve in fluid communication with each of said first and second chambers by first and second lines, respectively, said first and second chambers exhausting into said third and fifth chambers, respectively, through said directional control valve;

d. at least one rod interconnecting said first piston to each of said second and third pistons, wherein said first, second and third pistons are adapted for simultaneous, reciprocating movement in first and second directions;

e. first and second relief valves positioned for actuation at positions of said at least one rod to shift said directional control valve when said first, second, and third pistons are extended in said first and second directions, respectively.

10. An air-driven pump comprising:

a source of pressurized air;

a directional control valve;

a first pump unit including a first pump chamber, a first air chamber and a first piston therebetween, the first air chamber being in communication with the directional control valve;

a second pump unit including a second pump chamber, a second air chamber and a second piston therebetween, the second air chamber being in communication with the directional control valve;

a piston shaft affixed to both of the first and second pistons;

a control air component shifting the directional control valve responsive to stroke positions of the air-driven pump;

a high pressure pump unit including a high pressure cylinder and a high pressure piston with high pressure air chambers on either side of the high pressure piston, the high pressure piston being affixed to the piston shaft, the high pressure air chambers of the high pressure pump unit being pneumatically disposed in the communications between the directional control valve and the first air chamber and the second air chamber, such that pneumatic exhaust flow from each of the high pressure air chambers is provided to a corresponding one of the first and second air chambers to pressurize the first and second air chambers, respectively, the high pressure air chambers each having a maximum volume smaller than the maximum volume of either of the first air chamber and the second air chamber.

11. An air-driven pump comprising:

a source of pressurized air;

a directional control valve;

a piston shaft;

a control air component shifting the directional control valve responsive to stroke positions of the air-driven pump;

a high pressure pump unit including a high pressure cylinder and a high pressure piston with high pressure air chambers on either side of the high pressure piston, the high pressure piston being affixed to the piston shaft;

a low pressure pump unit including a low pressure cylinder and a low pressure piston with low pressure air chambers on either side of the low pressure piston, the low pressure piston being affixed to the piston shaft, the high pressure pump unit being disposed in the communications between the directional control valve and the second air chamber, such that pneumatic exhaust flow from each of the high pressure air chambers is provided to a corresponding one of the first and second air chambers to pressurize the low pressure air chambers, respectively, the high pressure air chambers each having a maximum volume smaller than the maximum volume of either of the low pressure air chambers;

a pumping unit including a pumping piston and pump chambers to either side of the pumping piston, the pumping piston being affixed to the piston shaft.

* * * * *

UNITED STATES PATENT AND TRADEMARK OFFICE

CERTIFICATE OF CORRECTION

PATENT NO. : 8,186,972 B1
APPLICATION NO. : 12/008948
DATED : May 29, 2012
INVENTOR(S) : Carl J. Glauber It is certified that error appears in the above-identified patent and that said Letters Patent is hereby corrected as shown below:

In claim 11, (col. 10, ll. 17-18), delete "second air chamber" and insert
-- low pressure cylinder -- therefor.

In claim 11 (col. 10, l. 20), delete "first and second air" and insert
-- low pressure air -- therefor.

Signed and Sealed this
Twenty-eighth Day of August, 2012

David J. Kappos

David J. Kappos
*Director of the United States Patent and Trademark Office*